US005617066A

United States Patent [19]

Dittmann et al.

[11] Patent Number: 5,617,066

[45] Date of Patent: Apr. 1, 1997

[54] POLARIZED ELECTROMAGNETIC RELAY

[75] Inventors: Michael Dittmann, Berlin; Heinz Stadler, München; Herbert Mitschik, Geretsried, all of Germany

[73] Assignee: Siemens Aktiengesellschaft, Munich, Germany

[21] Appl. No.: 525,674

[22] PCT Filed: Mar. 16, 1994

[86] PCT No.: PCT/DE94/00288

§ 371 Date: Sep. 25, 1995

§ 102(e) Date: Sep. 25, 1995

[87] PCT Pub. No.: WO94/22156

PCT Pub. Date: Sep. 29, 1994

[30] Foreign Application Priority Data

Mar. 24, 1993 [DE] Germany ..... 43 09 619.0
Jul. 23, 1993 [DE] Germany ..... 43 24 857.8

[51] Int. Cl.[6] ..... H01H 51/22
[52] U.S. Cl. ..... 335/78
[58] Field of Search ..... 335/78–86, 124, 335/128, 131

[56] References Cited

U.S. PATENT DOCUMENTS 3,247,344 4/1966 Rossell .
4,695,813 9/1987 Nobutoki et al. .
5,117,209 5/1992 Sato .
5,337,029 8/1994 Nobutoki et al. ..... 335/78

FOREIGN PATENT DOCUMENTS 0197391 10/1986 European Pat. Off. .
0423834 4/1991 European Pat. Off. .
0437209 7/1991 European Pat. Off. .
2491254 4/1982 France .

*Primary Examiner*—Lincoln Donovan
*Attorney, Agent, or Firm*—Hill, Steadman & Simpson

[57] ABSTRACT

The relay has a base (1) with stationary mating contact elements (11, 12, 13, 14), a coil (5), a permanent magnet (4) and also a rocker armature (3) which is arranged between the coil and the base, is connected to movable contact elements (21, 22, 23, 24) and is mounted on the base by means of bearing strips, the bearing strips simultaneously serving as electrical connections for the movable contact elements. The bearing strips (25, 26) are secured to the bearing supports (15, 16), which are designed as connection elements, of the base in planes extending at right angles to the basic plane of the base. As a result, the contact separation can be set with low tolerance even during production, and it is not dependent on tolerances of the individual parts. This structure consequently permits non-problematic, cost-effective production of the individual parts and accurate assembly without the requirement of subsequent adjustment.

19 Claims, 10 Drawing Sheets

POLARIZED ELECTROMAGNETIC RELAY

BACKGROUND OF THE INVENTION

1. Field of the Invention

The present invention relates to a polarized electromagnetic relay having

- a base which is made of insulating material, which defines a basic plane with its bottom side and in which are secured at least two stationary mating contact elements as well as two bearing supports for the armature,
- a coil, which is secured on the base and which has an axis parallel to the basic plane, a core and two pole shoes connected to the ends of the core,
- a permanent magnet arrangement which forms, in the region of the coil center, a center pole having a first pole direction and which produces poles at each of the pole shoes, the poles having a pole direction opposite to the first pole direction,
- a flat rocker armature, which is arranged approximately parallel to the coil axis and is pivotably mounted in the center thereof about a center axis which is parallel to the basic plane, and
- a contact arrangement, which is permanently connected to the armature, has at least two movable contact elements, which are embedded in an insulating material carrier and optionally cooperate with one of the mating contact elements, and have two bearing elements which are embedded in the insulating material carrier, issue at opposite sides of the armature and are connected to the bearing supports.

The invention additionally relates to a method for producing a relay of this type.

2. Description of the Related Art

A relay of the above-described type is disclosed, for example, in European Patent Document EP 0 423 834 A2. In the case of this relay as well as in the case of other miniature relays having a fundamentally similar structure, the various assemblies, that is to say the base with the stationary contact elements, the armature with the movable contact elements, and the coil assembly are arranged one above the other in a layer design, resulting in an accumulation of the manufacturing tolerances of the individual parts. Therefore, in the case of the known relay in accordance with European Patent Document EP 0 423 834 A2, the armature is secured by means of bearing elements which are secured, in the form of torsion webs and securing arms lying parallel to the base plane, so as to rest on supporting surfaces which likewise lie parallel to the basic plane.

SUMMARY OF THE INVENTION

The separations between the stationary contact elements and the movable contact elements connected to the armature are thus fixedly predetermined by the manufacture of the individual parts. This means that, on the one hand, the individual parts have to be produced in a manner involving very few tolerances, which is costly, but that in spite of this the tolerances which are present accumulate during assembly. Subsequent adjustment of the contact separations is thus essential and is also provided in the case of the known relay by bending on the securing tabs.

The aim of the present invention is to configure a relay of the type mentioned in the introduction in terms of its structure, and to specify a production or assembly method therefor, in such a way that the tolerances of the individual parts no longer have any influence on the contact separations. Therefore, the intention is to enable the movable and the stationary contact elements of the relay to be assembled in the correct position with respect to one another, irrespective of the accuracy of the individual parts, so that subsequent adjustment is no longer necessary.

This aim is achieved according to the invention in the case of a relay of the type mentioned in the introduction as a result of the fact that the bearing elements are designed as flat bearing strips which extend at least with a securing section at right angles to the base plane and are secured in a manner such that they rest flat against the bearing supports which are likewise arranged at right angles to the base plane.

In the case of the relay structure according to the invention, therefore, a departure is made from the previous layer design, and the connection between the movable parts and the stationary base is effected in connection planes which extend at right angles to the base plane and hence in the direction of the switching movement. Consequently, it is possible, during the assembly of the armature, for the contact separation to be set exactly and in a continuously variable manner and to be fixed by the securing of the bearing elements. As a result, the following are dispensed with: not only costly, low-tolerance manufacture of the individual parts, but also subsequent adjustment of the contact separations.

The two bearing strips each preferably extend with a flexible section next to the armature in such a way that, at every point of this section, the tangential plane lies parallel to the axis of rotation of the armature, that is to say the flexible section is subjected virtually only to bending stress in the event of movement of the armature. In a preferred embodiment the bearing strips are in this case each embedded in lateral projections of the insulating material carrier in such a way that they issue from the latter in a direction parallel to the longitudinal direction of the armature, are bent in a direction at right angles to the base plane and are secured on the parallel-extending securing tabs of the bearing supports. The two bearing strips preferably extend in a common direction which is at right angles to the longitudinal axis of the armature, in such a way that they are subjected to simple bending stress when the armature moves. If the bearing strips are simultaneously used as a power supply line to the movable contact elements, then they are respectively connected to at least one of these movable contact elements, preferably in one piece, while the bearing supports are connected, for their part, to connection elements in the base.

In order to relieve the securing points of the bearing strips during the switching operation, it is provided in an advantageous refinement that the end section of the respective bearing strip is clamped between the associated bearing support and an opposite clamping plate, which defines with an end edge a clamping point for the bearing strip before the securing point thereof. In this case, the clamping plate can be formed by an end section of the bearing support, which end section is bent over in the shape of a U and reaches around the end section of the bearing strip on its terminating edge or alternatively laterally. In this case, the cross section of the bend section between the actual bearing support and the clamping plate can be reduced, for example by embossing to reduce the thickness and/or lateral incisions to reduce the width. However, it is also possible for the clamping plate to be part of a U-shaped clamp plugged onto the free ends of the bearing support and of the bearing strip.

With the aid of the clamping plate or the U-shaped extension of the respective bearing support, therefore, the bearing strip secured thereon is clamped between the end edge of this clamping plate and the actual bearing support, with the result that this clamping point also simultaneously forms the bending point for the respective bearing strip during the armature movement. The actual securing point, which is preferably designed as a weld, is thus completely relieved of the movement forces.

Another possible way of relieving the securing point, which as a rule is a weld, can consist in arranging the bearing strip in each case with the flexible section between the armature and the bearing support and in securing it by a securing section, which is additionally molded on at the end or at the side, in a manner reaching around the bearing support, on a side of the bearing support which faces away from the flexible section. In this case, an edge of the bearing support is situated between the weld and the flexible section, again providing relief for the securing point.

The permanent magnet arrangement is preferably formed by a permanent magnet which is in the form of a bar, is arranged underneath the coil parallel to the coil axis and has like poles at each of the ends and an unlike pole with respect thereto in the center.

A preferred method for producing a relay according to the invention comprises the following steps:

a) the armature connected to the contact arrangement is arranged on the base in such a way that the bearing strips rest, with the capability of being displaced vertically, against the bearing supports;
b) a predetermined contact separation is set by vertically displacing the armature;
c) the bearing strips are connected to the bearing supports in the set position of the armature;
d) the coil equipped with the core, the pole shoes and the permanent magnet is pushed on to the base from above until predetermined operating air gaps of the armature are achieved.

In an expedient method for securing the bearing strips on the bearing supports, after the contact separation has been set, the bearing strips are initially prefixed by a weld on the bearing support, preferably by a laser weld on the end edge of the bearing strip, and an end section of the bearing support is then bent, to form a clamping plate, in the shape of a U over an end edge of the bearing strip, the sections of the bearing support, of the bearing strip and of the clamping plate resting against one another being welded together thereafter. In this case, one or more welds are expediently produced in the edge region of the bearing strips and of the bearing supports or clamping plates using a laser welding method or a similar spot welding method. However, it is also possible to use any desired welding method, preferably a TIG welding method, to fuse together the composite region of the bearing support, the bearing strip and, if appropriate, the clamping plate at its free end.

BRIEF DESCRIPTION OF THE DRAWINGS

The invention is explained in more detail below using an exemplary embodiment with reference to the drawing, in which.

DETAILED DESCRIPTION OF THE PREFERRED EMBODIMENTS

Figure 1:
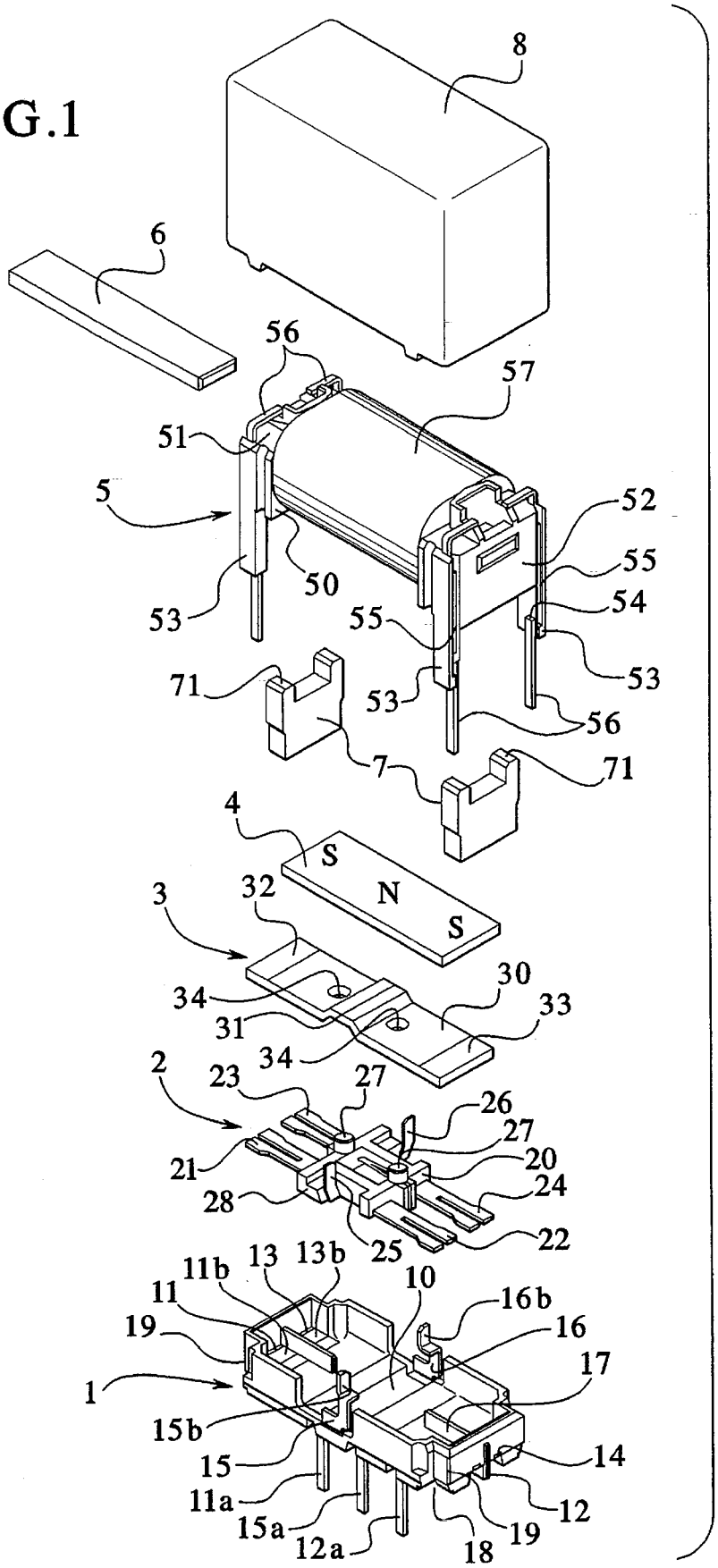
FIG. 1 is an exploded illustration of a relay configured according to the invention.
Figure 2:
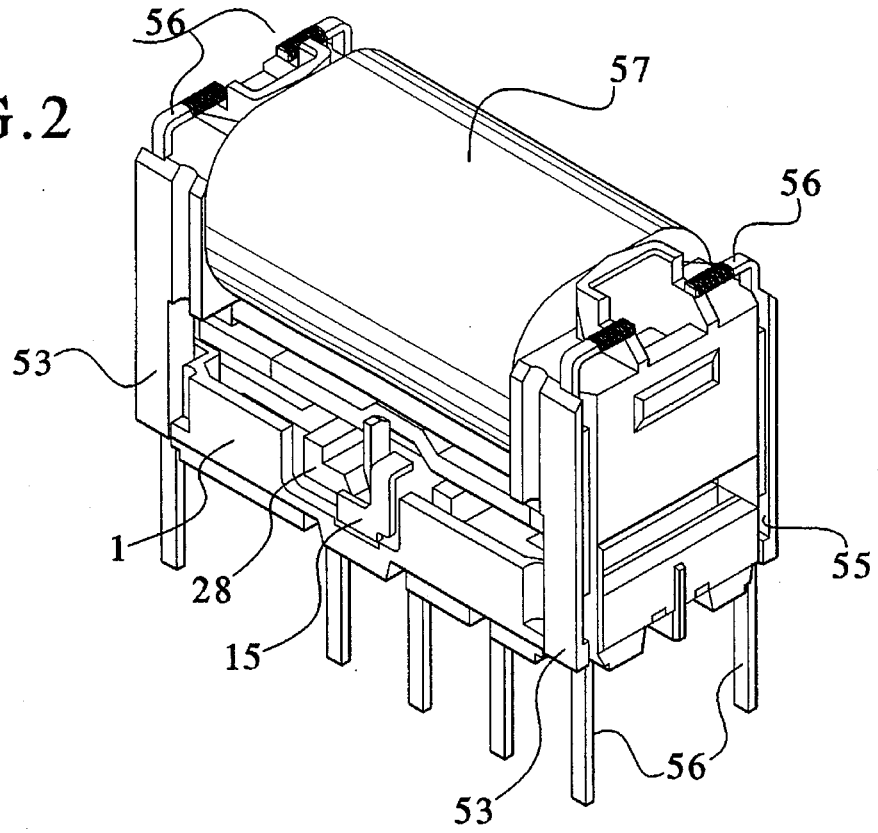
FIG. 2 is a perspective illustration of a completely assembled relay according to FIG. 1, but without a cap.
Figure 3:
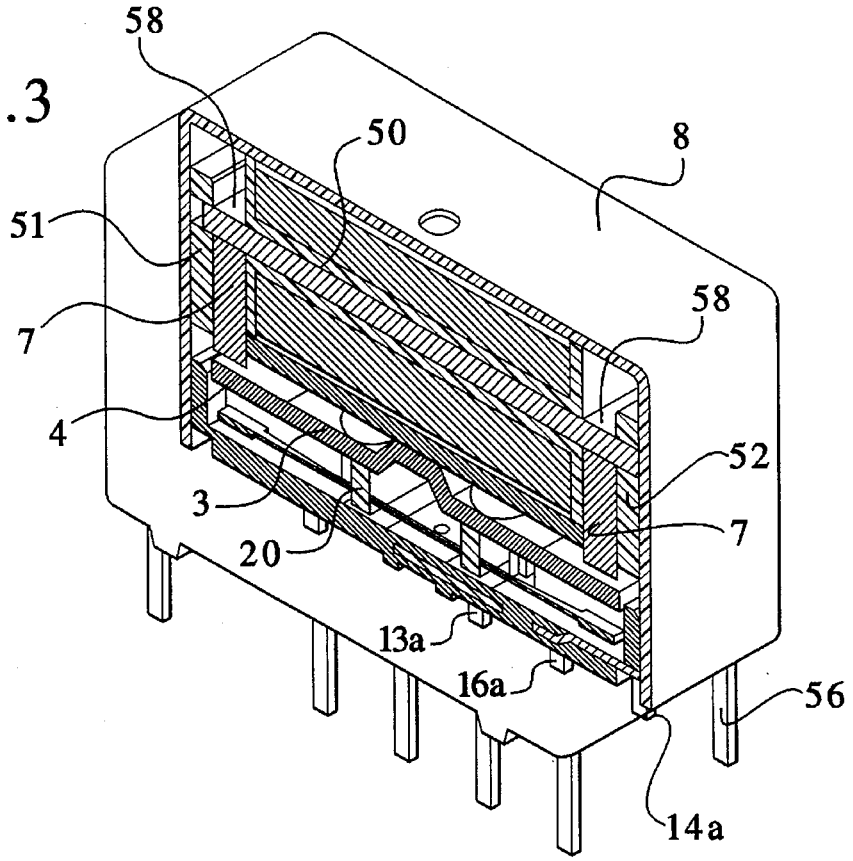
FIG. 3 is an eccentric longitudinal section of a relay in accordance with FIG. 2 with the cap having been put on, FIG. 4 is an enlarged illustration of a base and of an armature assembly prior to assembly.
Figure 4:
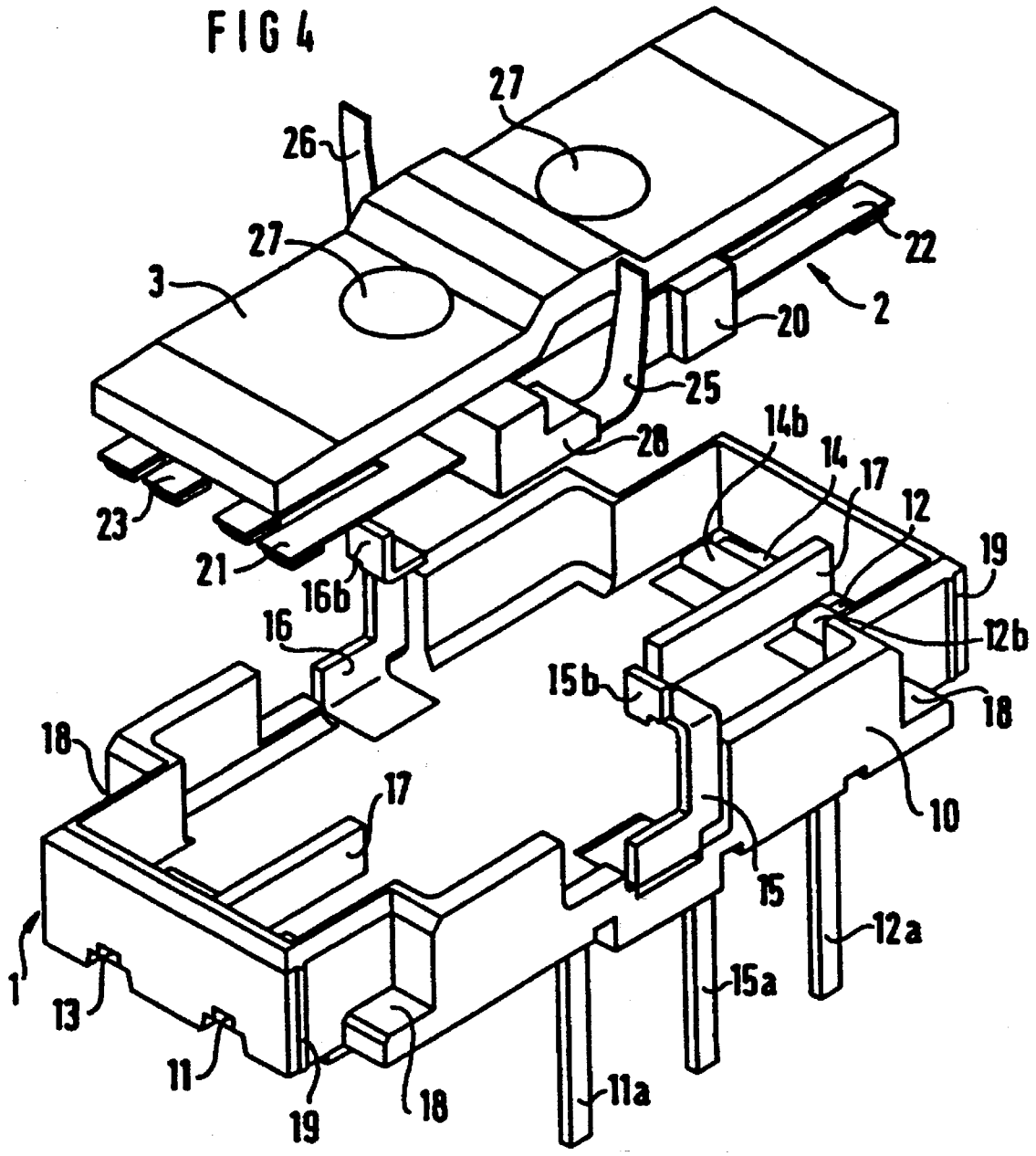

The relay illustrated in the drawing has a base 1, on which there is movably mounted a contact arrangement 2 which, for its part, is permanently connected to a rocker armature 3. Arranged above the armature, approximately parallel thereto, is a flat permanent magnet 4, which is situated with a center pole (N) above the bearing point of the armature and has at its ends two poles (S) which are unlike the center pole. A coil 5, into which a core 6 in the form of a bar is axially pushed, is arranged above the permanent magnet and above the armature. A pole shoe 7 is connected to each end of the core 6. Each of the pole shoes 7 is also coupled in the region of a coil end to an end of the permanent magnet 4 and toward the bottom forms a pole face for the armature 3. A closed housing is finally formed when a cap 8 is placed on to the base 1, which housing can also be sealed in a conventional manner.

The base 1 comprises a basic, base body 10, which is formed from insulating material and in which stationary mating contact elements 11, 12, 13 and 14 as well as connection elements 15 and 16 for movable center contact elements are anchored. All of these contact elements are expediently cut from a common circuit board and embedded into the basic body with a securing section parallel to the bottom surface of the base. Connection pins, for example 11*a*, 12*a* and 15*a*, are each bent at right angles to the underside of the base from these embedded sections. The mating contact elements 11, 12, 13 and 14 themselves are exposed on the top side of the bottom in the trough-shaped basic body 10 of the base and are provided with weld profiles 11*b*, 12*b*, 13*b* and 14*b*. However, the connection elements 15 and 16 are bent upward at opposite sides of the base, where they form two bearing supports 15*b*, 16*b* for the movable contact arrangement and for the armature as a result of corresponding portions bent off at an angle and offset portions. A rib 17 for increasing the insulating clearances is in each case molded on between the respectively adjacent stationary mating contact elements 11 and 13, and 12 and 14. Moreover, the basic body has a cutout 18 at each of the corners for the purpose of plugging on the coil 5. Vertical ribs 19, the function of which will be described further below, are in each case molded on to the vertical wall of the basic body 10 in the region of these recesses.

The movable contact arrangement 2 has a contact carrier 20 which is made of insulating material and in which contact springs 21, 22, 23 and 24 are embedded. These contact springs optionally cooperate with the stationary mating contact elements 11, 12, 13 and 14 located underneath them. In order to form two changeover contacts, the contact springs 21 and 22 are integrally connected in the present example, with the result that they form a center contact element which is mechanically and electrically connected via a bearing strip 25 to the connection element 15 in the base. The contact springs 23 and 24 are correspondingly integrally connected to a bearing strip 26 and coupled to the connection element 16. The contact arrangement 2 is permanently connected to the armature 3 by means of two securing journals 27.

The armature 3 comprises a flat iron strip 30, the center region of which is bent up to form a transversely extending bearing web 31. As a result, the armature can ride on the permanent magnet 4 situated above it and optionally rest with one of its pole faces 32 or 33 against one of the pole shoes 7. The bores 34 serve to accommodate the fastening journals 27 of the contact arrangement, which journals can be fixed in these bores by hot forming.

The coil 5 has a coil former 50 which is formed from insulating material, carries a winding 57 between two flanges 51 and 52 and accommodates the core 6, which in the form of a bar, in the coil former tube. At the four corners of the system, the coil flanges 51 and 52 have attachments 53 which are each extended downward, engage over the base 1 in the form of a box and come to lie in the recesses 18 in the base. Molded in each case on to the inner sides of the projections 53 are transverse ribs 54, which each lie in the shape of a cross with the longitudinal ribs 19 of the base and thus ensure a tight fit in any position. Vertical grooves 55, into which coil connection elements 56 are inserted, are in each case provided in the coil flanges 51 and 52 and in the projections 53. However, in another embodiment they could also be embedded into the material of the coil former.

During the assembly of the coil assembly, the pole shoes 7 are inserted from below into corresponding channels in the coil former flanges 51 and 52, the forked ends 71 of the shoes each embracing the core 6 situated in the coil former tube. However, it would also be conceivable to provide each of the pole shoes 7 with a perforation which is closed at the top; it would then be necessary to plug the pole shoes on to the core in the axial direction.

During the assembly of the relay, the movable contact arrangement 2 is initially united with the armature 3 to form an armature/contact assembly, the securing journals 27 being anchored in the bores 34 by hot forming in the manner described above. This armature/contact assembly is then connected to the base 1, the contact separations being set in a defined manner. This will now be explained in more detail with reference to FIGS. 4 to 7.

The bearing strips 25 and 26, which are simultaneously used as electrical connection tabs for the center contact elements 21/22 and 23/24 and are cut in one piece with the latter from a circuit board, each issue essentially horizontally from the insulating material carrier 20 of the contact arrangement. For this purpose, this carrier 20 has lateral attachments 28, from which the two bearing strips issue in the longitudinal direction of the armature, at which point they are then bent up vertically with a comparatively small radius. These upwardly bent sections of the bearing strips thus lie in a common plane which is at right angles to the basic, base, plane and, on the other hand, also approximately passes through the bearing axis of the armature. In the assembled relay, therefore, the bearing strips 25 and 26 are not subjected to torsional stress but merely to simple bending stress. The ribs 17 are used as a means of impact protection against an excessive deflection of the armature in its longitudinal direction, the attachment 28 striking the ribs in the event of impacts.

Figure 5:
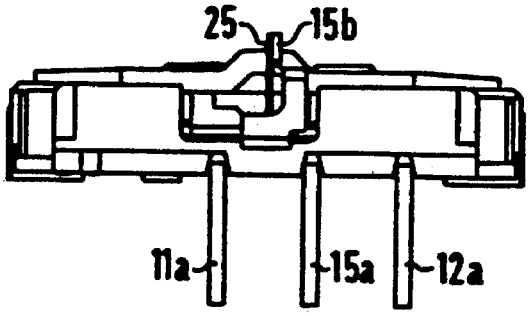
FIGS. 5 and 6 show a base with the armature assembly having been assembled, once in a side view (FIG. 5) and once in a longitudinal section (FIG. 6)
Figure 6:
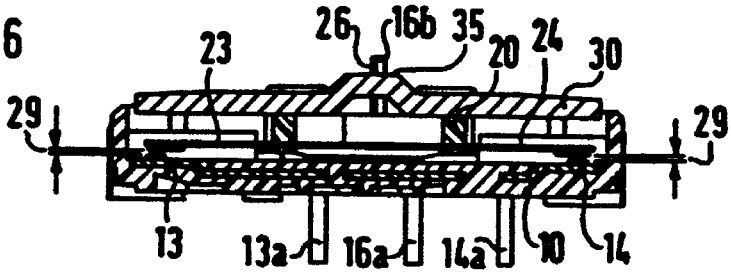
Figure 7:
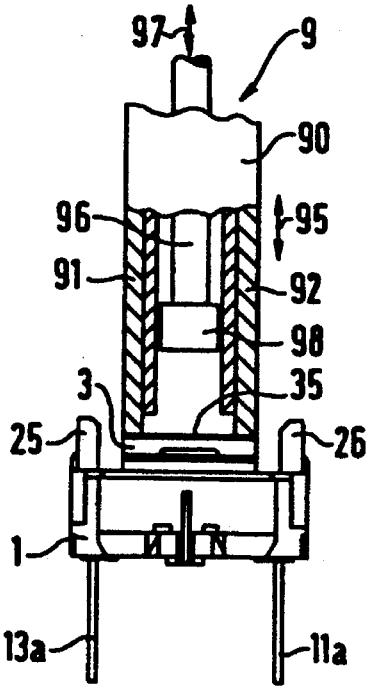
FIG. 7 shows a base and an armature assembly, seen from the front, with an assembly device.

After the insertion of the armature/contact assembly into the base 1 in accordance with FIGS. 5 and 6, the contact separations 29 (for the center position of the armature) are set to predetermined, identical values. This is preferably carried out using a device in accordance with FIG. 7 or using a comparable device. After the bearing strips 25 and 26 have been aligned with the bearing supports **15*b* and 16*b* of the basic body, the armature/contact assembly lies with the contact springs 21, 22, 23 and 24 on the associated mating contact elements 11, 12, 13 and 14. The bearing strips or connection tabs 25 and 26 rest with their vertical contact surfaces against the bearing supports 15*b* and 16*b* of the connection elements 15 and 16. The assembly device 9 illustrated in FIG. 7 contains a diagrammatically shown measuring device 90, which is brought up (double arrow 95), with two electrically conductive legs 91 and 92 to a coupling point on the top side 35 of the armature, until there is electrical continuity from the leg 91 via the armature to the leg 92 and this is established in the abovementioned measuring device. If the armature is not straight on account of a deformed contact spring, then a certain pressure force is required to produce the electrical continuity via the armature. The magnitude of the deformation can be derived from the magnitude of this required pressure force; if a maximum permissible, predetermined force is exceeded, the armature system is rejected as defective. If, however, it has been established by the abovedescribed first measuring step that the armature/contact assembly is sufficiently planar, the measuring device moves further downward by a prescribed distance, that is to say in the direction of the base 1. In this state, an electrical connection must occur between the four contact springs 21, 22, 23 and 24, on the one hand, and the associated mating contact elements 11, 12, 13 and 14 in the base. This is determined by measurement at the connection pins 11*a*, 12*a*, 13*a* and 14*a*. This test operation ensures that in each case at least one contact arm of the contact springs 21, 22, 23 and 24**, which are each subdivided into two arms, guarantees an adequate excess stroke. The structure according to the invention consequently enables functional testing even before the securing of the armature assembly; defective assemblies can thus be rejected early on.

After this excess stroke test, a slide 96 located in the measuring device 90 is lowered in the arrow direction 97). The armature 3 is detained by a permanent magnet 98 fixed on the slide 96. The measuring device is now moved up (double arrow 95) with the armature assembly —taking account of the excess stroke—by a distance (FIG. 6) which corresponds to the desired contact separation 29. The bearing strips 25 and 26 of the armature/contact assembly are now at the desired height relative to the bearing supports **15*b*, 16*b* of the base assembly. In this position, the bearing strips 25 and 26 are respectively welded to the bearing supports 15*b* and 16*b*** against which they rest. The welding may be effected, for example, as resistance welding or laser welding.

Afterwards, the magnetic system, the coil 5 with the core 6, the pole shoes 7 and the permanent magnet 4, is pushed on to the base assembly until the desired armature stroke is reached. The coil former 50 clamps on the basic body 10 of the base, the horizontal ribs 54 of the coil former on the vertical ribs 19 of the base—if necessary together with further ribs (not illustrated) on both parts—ensuring a tight fit in any desired position. Both monostable and bistable switching properties of the relay can be achieved by adjusting the permanent magnet 4. A monostable switching property can also be achieved by means of an additional partition (not illustrated) which is placed between one of the pole shoes 7 and the associated pole face 32 or 33 of the armature. After the cap 8 has been put on, the relay is sealed with casting resin in the base region.

Figure 8:
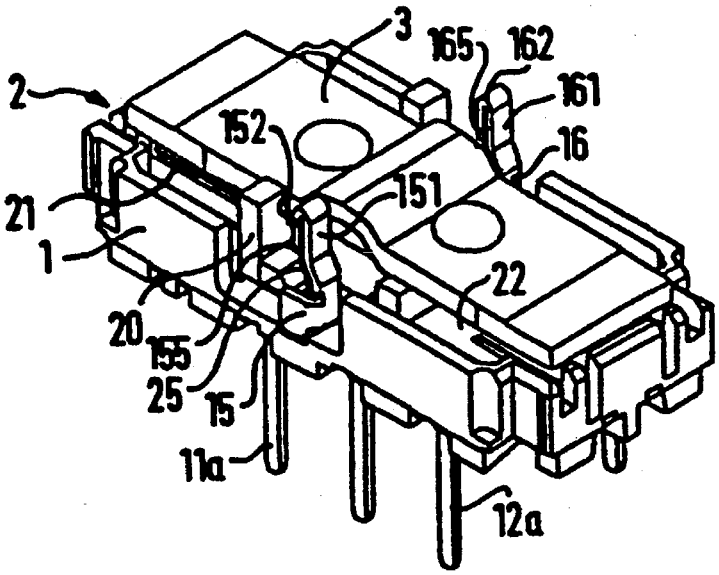
FIG. 8 is a perspective view which shows the base with the assembled armature assembly for a relay which has a modified means of securing the armature.
Figure 9:
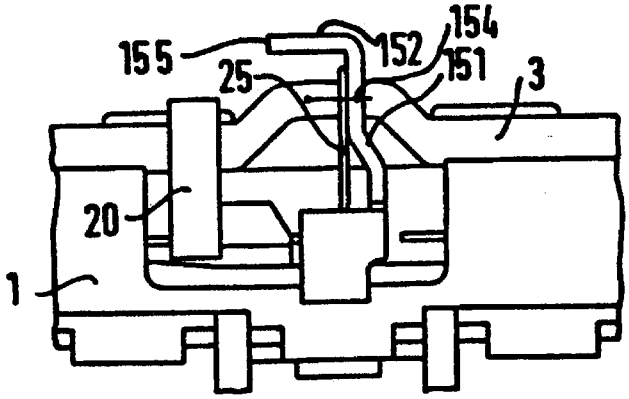
FIGS. 9 and 10 show a side view (as a detail) of the arrangement of FIG. 8, in different phases of securing a bearing strip.
Figure 10:
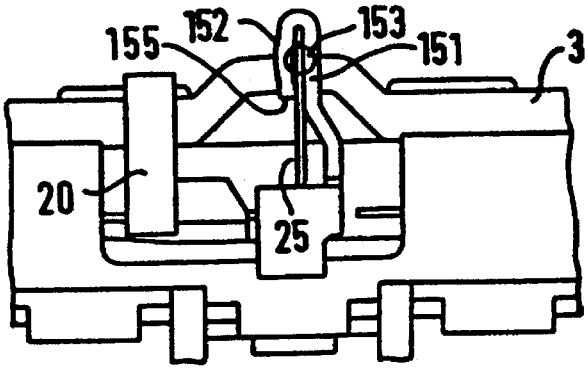

FIGS. 8 to 10 show the base region of the relay with the armature and modified bearing and securing. The relay in accordance with FIG. 8 has a base 1 on which is movably mounted a contact arrangement 2, which, for its part, is permanently connected to a rocker armature 3. Anchored in the base are stationary mating contact elements (not visible here), of which only the connection elements 11*a* and 12*a* are visible, and also connection elements 15 and 16 for movable center contact elements, for example 21 and 22, which are embedded in an insulating material carrier 20 of the contact arrangement 2 and are connected to the armature 3 via the carrier.

The center contact elements form two bearing strips 25 and 26 which are bent up approximately vertically, which are used as an electrical and mechanical connection to the base and which effect pivotable mounting of the armature 3. For this purpose, the connection elements 15 and 16 each have bearing supports 151 and 161 which are molded on vertically upward and, furthermore, are each provided with an extension 152 and 162 and in the shape of a U. The bearing strips 25 and 26 are connected to the bearing supports 151 and 161, respectively, via a weld 153 in each case (FIG. 10), relief of the weld being achieved by the extension 152 and 162 bent in the shape of a U.

In accordance with a first variant, the assembly of the armature can be performed in such a way that the extension 152 (and 162) is initially bent only through approximately 90° relative to the associated bearing support 151 (and 161) when the armature 3 with its bearing strips 25 and 26 is inserted. The bearing strips 25 and 26 are initially pre-fixed or attached only on the associated bearing support 151 and 161; this is done by means of resistance welding, indicated by the weld 154 in FIG. 9, or by notching. However, laser welding on the end edge of the bearing strip 25 and 26 is also expedient. The extension 152 and 162 respectively, is subsequently bent down until the end edge 155 and 165, respectively, rests against the bearing strip 25 and 26, respectively (see FIG. 10). The bearing strips 25 and 26 are then finally secured on the associated bearing support 151 and 161 by laser welding; this weld is designated by 153.

Figure 11:
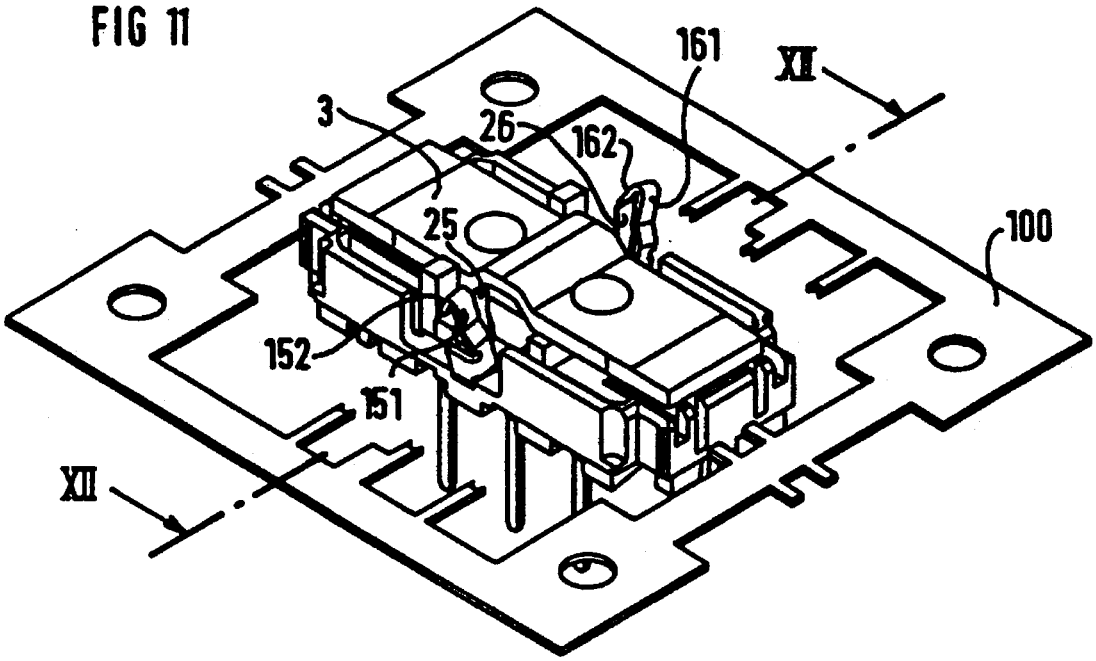
FIGS. 11 and 12 are perspective illustrations and sections of a slightly modified assembly method for the armature, to be precise the state after the insertion of the armature and prior to the securing of the bearing strips.
Figure 12:
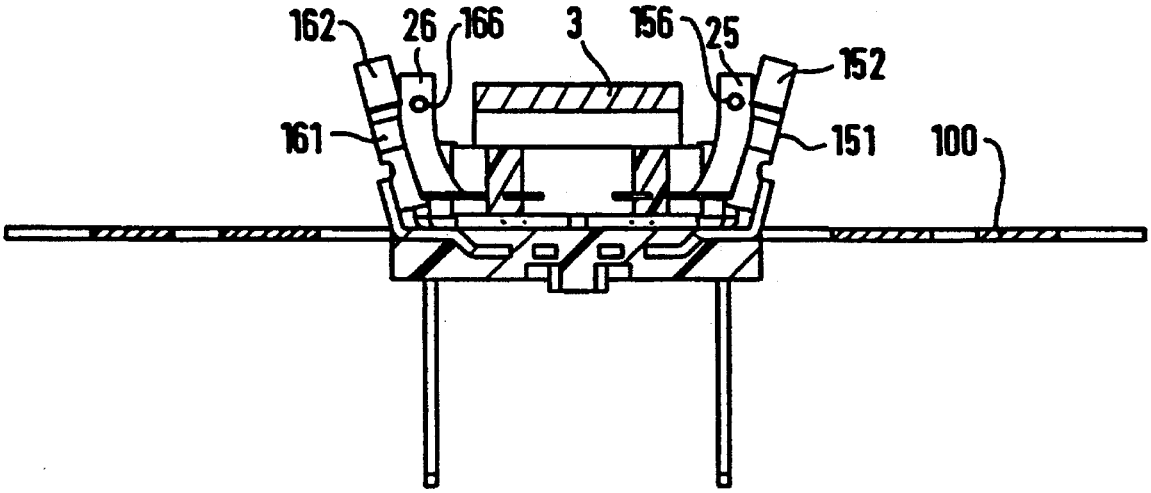

In a further variant as shown in FIGS. 11 and 12, the extension 152 and 162, respectively, of the bearing support 151 and 161, respectively, is initially bent in the shape of a V and in the process closed down to about 20°. In addition, the two bearing supports 151 and 161 are also bent obliquely outward, with the result that they form an angle of about 80° with respect to the bottom plane or to the plane of the circuit board 100 which is still partially connected to the base. This enables the armature with the contact arrangement and with the bearing strips 25 and 26 to be inserted from above between the bearing supports, as can be seen clearly in FIG. 12. After the insertion of the armature assembly, the bearing supports 151 and 161 are bent inward until they are at right angles to the basic plane and embrace the ends of the bearing strips 25 and 26, respectively, with their extensions 152 and 162, respectively, which have been pre-bent in the shape of a V. When the armature assembly is set to the correct contact separation, the extensions 152 and 162 of the bearing supports are pressed together to their final U-shape, with the result that they embrace the ends of the bearing strips 25 and 26. These bearing strips 25 and 26 respectively have mamillated embossings 156 and 166 or bent portions which, during this deformation of the extensions 152 and 162, attain a permanent connection to the bearing supports 151 and 161, after the manner of a cold welding. This achieves pre-fixing of the extensions 152 and 162 to the bearing strips 25 and 26, respectively. The final fixing is then carried out as in the previous case, preferably by laser welding.

In the two last-mentioned variants, the bent extensions 152 and 162 have in each case a slightly convex shape, as can be seen most clearly in FIG. 10. In this way, only the lower edge 155 and 165, respectively, of the extension presses against the bearing strip 25 and 26, respectively; the latter is consequently clamped on both sides in the region of this terminating edge 155 and 166, respectively, as a result of which the actual weld 153 is relieved in the event of movements of the rocker armature.

Figure 13:
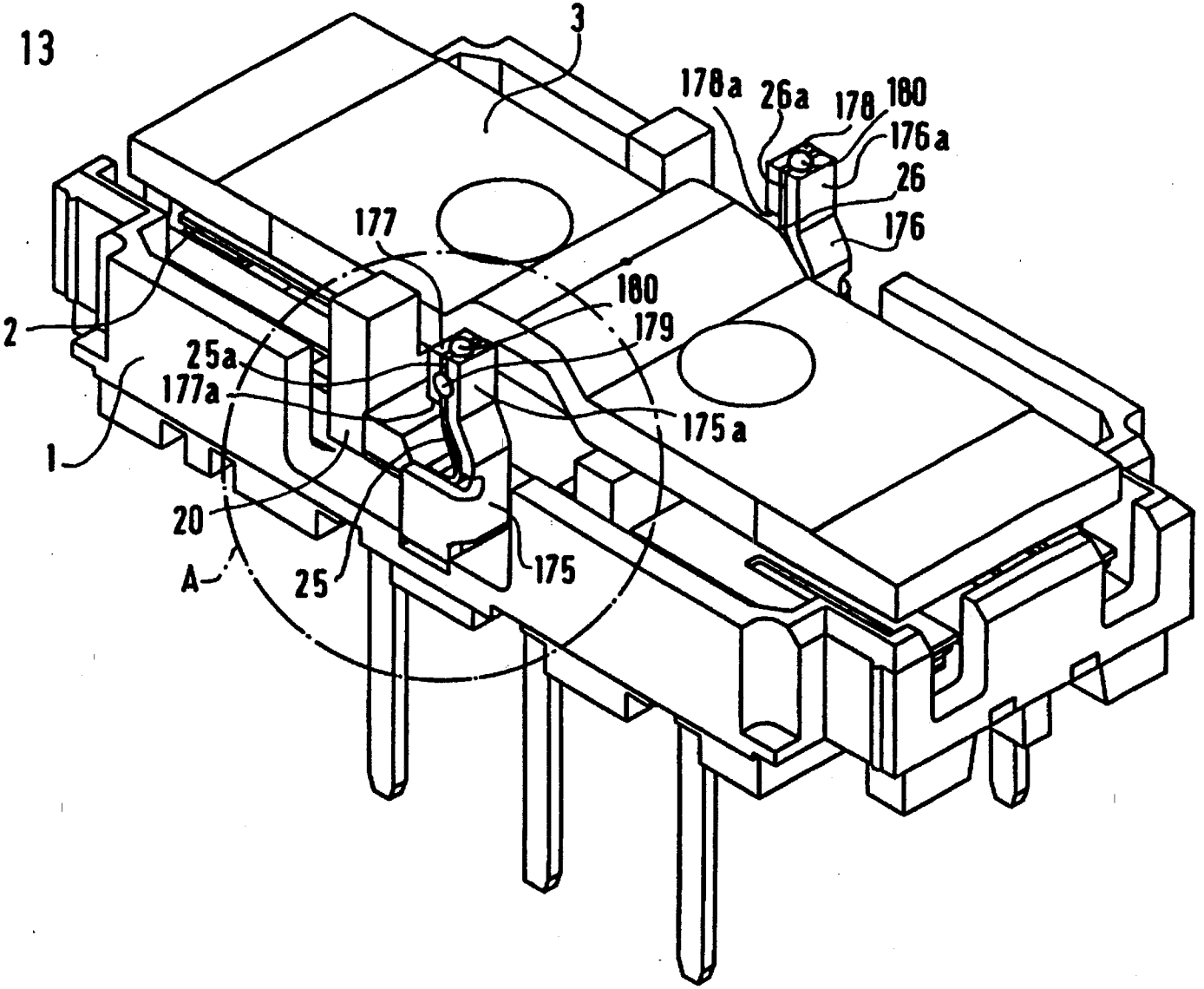
FIG. 13 is a perspective view of a base with the armature assembly having been assembled, the bearing strips being secured by an additional clamping plate.
Figure 14:
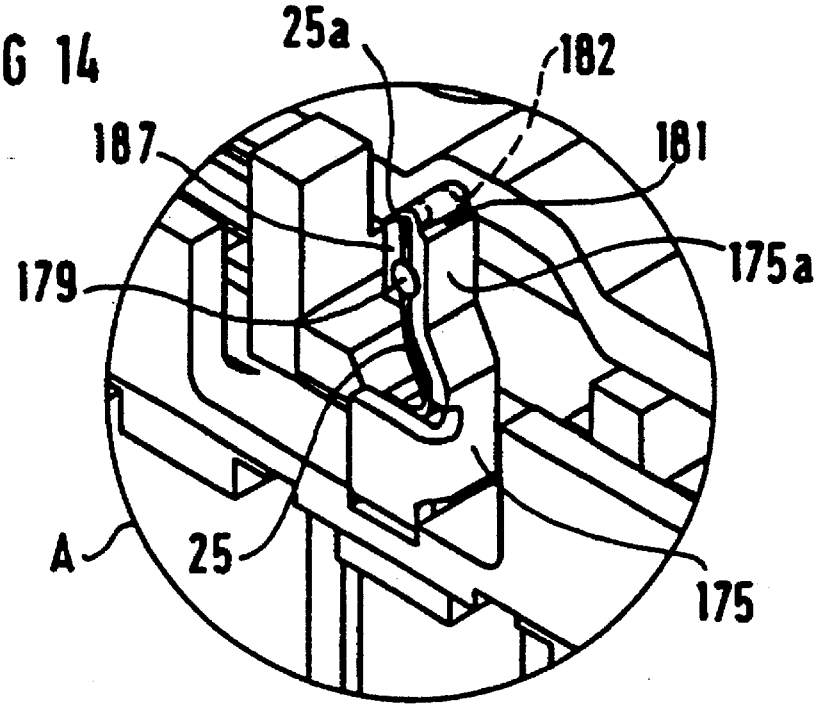
FIGS. 14 to 19 are enlarged detail views in perspective which show modified embodiments of the bearing region A from FIG. 13 with various possible ways to secure a bearing strip on a bearing support.

A further expedient modification of the bearing and fastening of the armarture is shown in FIG. 13, in principle the same view as in FIG. 8 being shown. Therefore, an armature 3 with a contact arrangement 2 is arranged on a base 1. The armature has bearing strips 25 and 26 which issue from the contact carrier 20 at the sides and the flexible section of which merges with an end section 25*a* and 26*a*, respectively, at least the latter being at right angles to the base plane and resting against an end section 175*a* and 176*a*, respectively, of a bearing support 175 and 176, respectively, which end section is likewise at right angles to the base plane. Arranged opposite the end sections 175*a* and 176*a* of the bearing supports is an additional clamping plate 177 and 178, respectively, which clamps the end section 25*a* and 26*a*, respectively, of the respective bearing strip and forms with its lower edge 177*a* and 178*a*, respectively a clamping point for relieving the weld 179. This weld 179 is made as a laser weld, at a certain distance from the lower edge 177*a*, in the region of the side edges, which are placed one on top of the other in layers, of the end sections 175*a* of the bearing support, 25*a* of the bearing strip and of the clamping plate 177. A further weld 180 may also be provided on the top side. The bearing strip 26 is secured on the opposite side of the armature in the same way. FIG. 14 shows a modification of the bearing region. A, a bearing plate 187 having been produced by a U-shaped bent portion of the end section of the bearing support 175. The functioning and the securing of the clamping plate 187 is otherwise exactly the same as in the case of the clamping plate 177.

The arrangement of FIG. 14 with the end of the bearing support bent in the shape of a U approximately corresponds to the illustration in FIGS. 8 to 10. However, the cross section of the bent region between the bearing support 175*a* and the clamping plate 187 is reduced in the case of the embodiment in accordance with FIG. 14. For this purpose, the bearing support is provided, prior to being bent, with an embossment 181 on the outside. In addition, the width of the bearing support may also be reduced by incisions 182 (illustrated by broken lines). In this way, the bearing support 175 or the clamping plate 187 can be bent using small forces during assembly, without in the process impairing the dimensionally accurate anchoring in the basic body. In this case, it is also no longer necessary initially to carry out partial bending in accordance with FIG. 9. During assembly, the end edge of the bearing strip 25 and 25*a* is attached by a laser weld to the section 175*a* of the bearing support only after adjustment of the armature and of the bearing strips 25 and 26, and then the pre-embossed clamping plate is bent over the end of the bearing strip. The weld 179 is produced in the manner described above.

Figure 15:
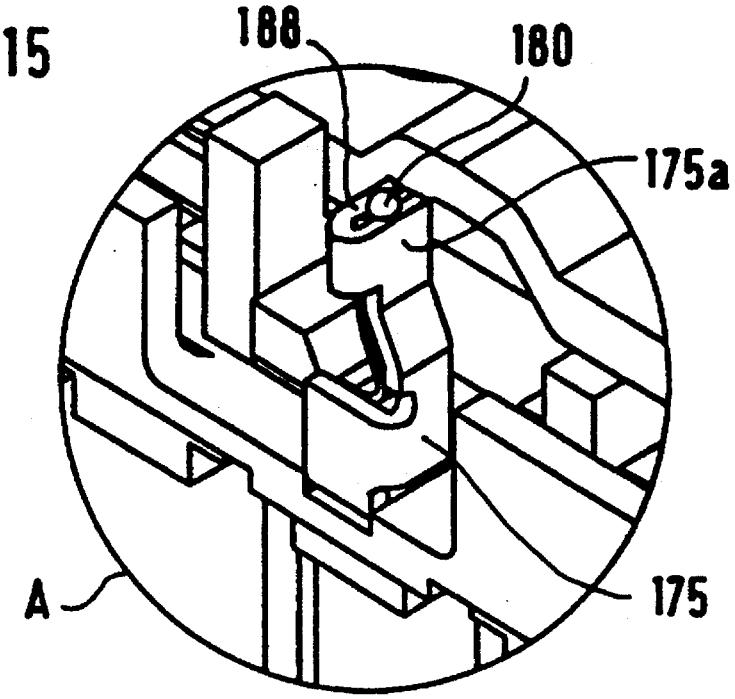
Figure 16:
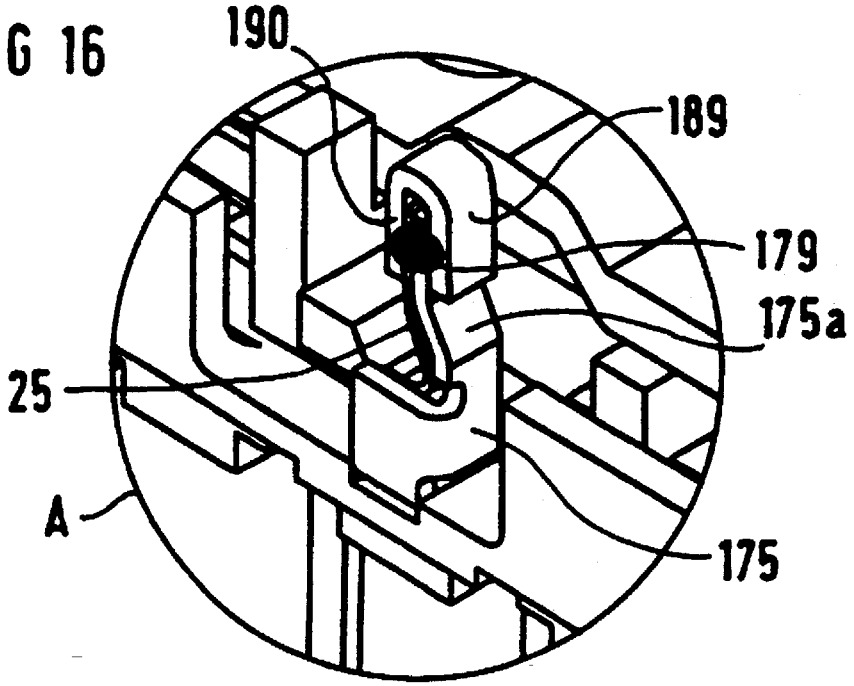

A further possible embodiment of the bearing region is shown in FIG. 15. A U-shaped bent portion is likewise provided in this case in order to produce a clamping plate 188, but the plate is now bent over the side edge of the bearing support 175 rather than over the terminating edge thereof. Relief of the weld 180, which is now situated at the top, is also achieved in this case. As shown in FIG. 16, a U-shaped clamping element 189 that is put on in addition could also be used in order to relieve the weld 179, which clamping element thereby forms a clamping plate 190. The weld 179 is situated at the same point as in FIG. 14.

Figure 17:
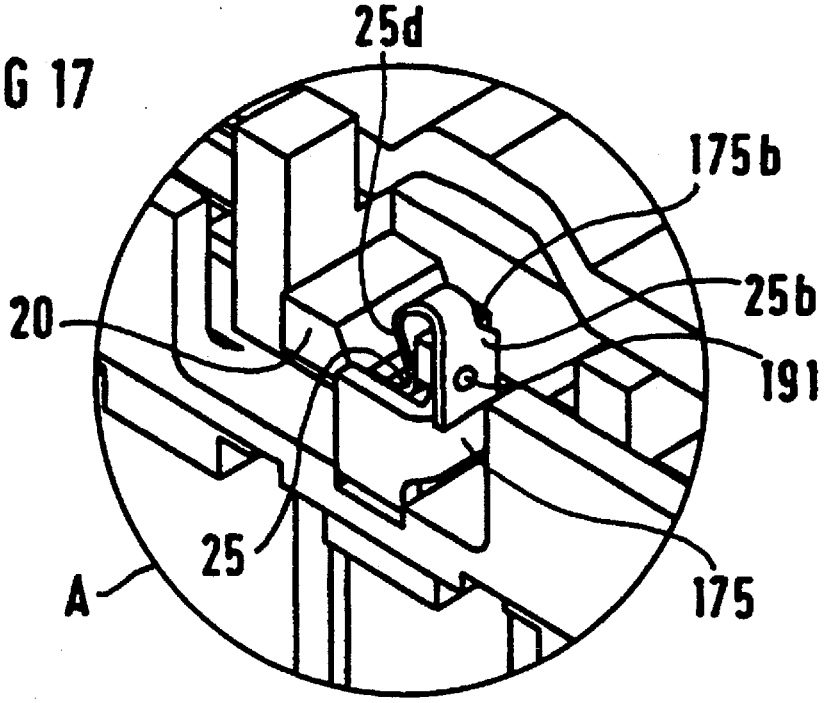

FIG. 17 shows a further possible way of relieving the weld without an additional clamping plate. Although a flexible section 25*d* of the bearing strip 25 is arranged between the contact carrier 20 and the bearing support 175 in this case, as previously, the section is also situated such that, at every point of the bearing strip, a tangential plane lies parallel to the pivot axis of the armature. However, an end section 25*b* is now bent over an end edge 175*b* of the bearing support 75 into the vertical position and secured, by a weld 191, on that side of the bearing support which is opposite to the flexible region. Since the bearing strip rests against the edge 175*b*, the weld 191 is relieved in this case, too, in the event of movement of the armature.

Figure 18:
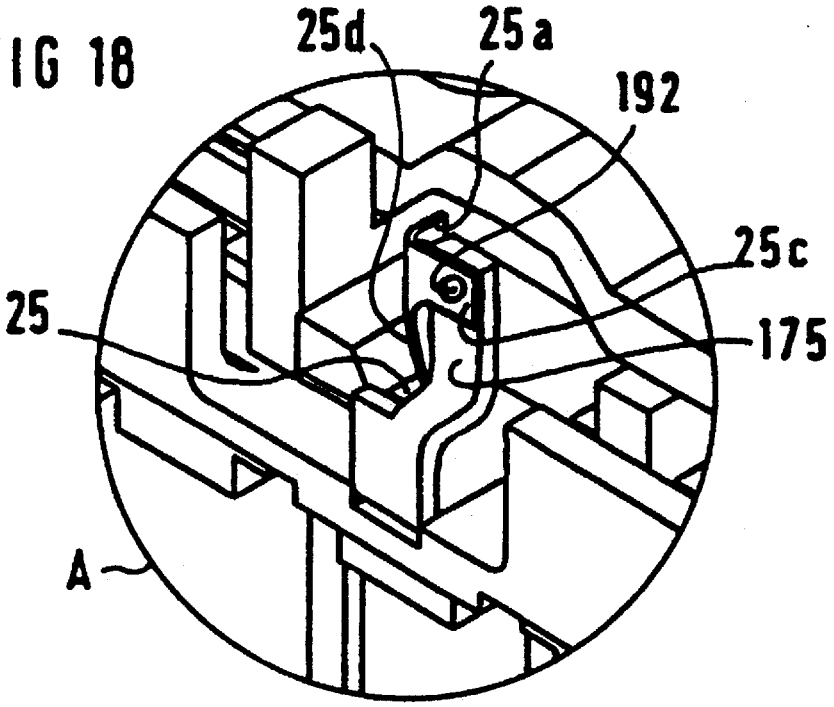

In a modification of the embodiment of FIG. 17, in accordance with FIG. 18 a lateral tab 25*c* is bent off at the end of the bearing strip 25 and welded (weld 192) to the outer side of the bearing support 175. In this case, too, the end section 25*a*, just like the bent-off tab 25*c*, is at right angles to the base plane, that is to say it permits adjustment prior to securing. Nevertheless, the weld 192 is decoupled from the flexible section 25*d* of the bearing strip 25 in this case, too.

Figure 19:
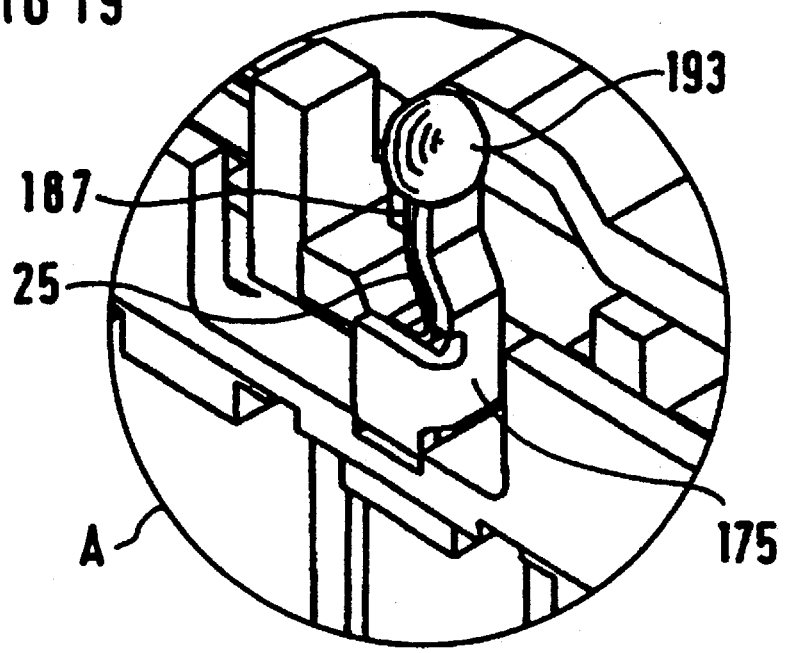

FIG. 19 shows a further possible way of securing the bearing strip 25 on the bearing support 175. Shown in this case is the embodiment in accordance with FIG. 8 or FIG. 14, the bearing support 175 being bent at its end in the shape of a U over the end of the bearing strip 25, in order to detain the latter. Instead of the previously shown laser weld, the curved end of the bearing support 175 and of the bearing plate 187, including that end edge of the bearing strip 25 which is clamped between these two, is now fused to form a weld head 193. This can preferably be effected by TIG welding (tungsten/inert gas welding) or by another welding method.

Generally, attention is also drawn to the fact that not only the described welding method but also other possible securing methods come into consideration for the bearing strips, for example soldering methods, possibly bonding methods as well if the bearing strips are not used as a power supply line, and alternatively mechanical joining methods with rivet-like deformation of the parts to be connected.

Although other modifications and changes may be suggested by those skilled in the art, it is the intention of the inventors to embody within the patent warranted hereon all changes and modifications as reasonably and properly come within the scope of their contribution to the art.

We claim:

1. A polarized electromagnetic relay, comprising:

a base which is made of insulating material, defines a basic plane with its bottom side and in which are secured at least two stationary mating contact elements as well as two metallic bearing supports for an armature, said bearing supports being at sides of said armature, a coil, which is secured on the base and has an axis parallel to the basic plane, a core and two pole shoes connected to ends of the core, a permanent magnet arrangement which forms, in a region of the coil center, a center pole having a first pole direction and produces at each of the pole shoes poles having a pole direction opposite to said first pole direction, a flat rocker armature, which is arranged approximately parallel to the coil axis between the base on one hand and the coil and the permanent magnet arrangement on another hand and is pivotably mounted in the center thereof about a center axis which is parallel to the basic plane, and a contact arrangement, which is permanently connected to the armature, has at least two movable contact elements, which are embedded in an insulating material carrier and optionally cooperate with in each case one of the mating contact elements, and have two bearing elements which are embedded in the insulating material carrier, said bearing elements being at opposite sides of the armature and are connected to the bearing supports, wherein the bearing elements are flat bearing strips which extend at least with a securing section at right angles to the basic plane, said flat bearing strips having no significant portions extending parallel to said basic plane, said flat bearing strips each being embedded in lateral projections of said insulating material carrier, issue from said insulating material carrier in a direction parallel to the longitudinal direction of the armature, are bent in a direction at right angles to the basic plane and are secured on the bearing supports extending parallel to said direction and the bearing supports form vertical bearing faces, against which the securing sections of the bearing strips lie flat, and are secured in a vertical position which can be set in a continuously variable manner.

2. A relay as claimed in claim 1, wherein the two bearing strips each extend with a flexible section next to the armature in such a way that, at every point of this section, the tangential plane lies parallel to the axis of rotation of the armature, that is to say the flexible section is subjected to bending stress in the event of movement of the armature.

3. A relay as claimed in one of claim 1, wherein the bearing strips are each connected to at least one of the movable contact elements and the bearing supports are connected to connection elements for the movable contact elements.

4. A relay as claimed in claim 1, wherein the insulating material carrier with the movable contact elements is arranged parallel to and underneath the armature and is secured by means of formed journals in recesses of the armature.

5. A relay as claimed in claim 1, wherein the stationary mating contact elements and, if appropriate, the connection elements for the movable contact elements are embedded into the base jointly in a lead frame, and in each case, connection pins are bent downward from the base and the bearing supports are bent upward.

6. A relay as claimed in claim 1, further comprising:

a coil former which carries the coil winding has flanges at both ends, which flanges are secured by downwardly directed projections with a press fit together with corresponding walls of the base in a manner engaging one into the other in the form of a box.

7. A relay as claimed in claim 1, wherein the end section of the respective bearing strip is clamped between the associated bearing support and an opposite clamping plate, which defines with an end edge a clamping point for the bearing strip before the securing point thereof.

8. A relay as claimed in claim 7, wherein the clamping plate is formed by an end section of the bearing support, which end section is bent over in the shape of a U and reaches around the end section of the bearing strip on its terminating edge or laterally.

9. A relay as claimed in claim 8, wherein the cross section of the bend section between the actual bearing support and the clamping plate is reduced.

10. A relay as claimed in claim 7, wherein the clamping plate is part of a U-shaped clamp plugged on to the free ends of the bearing support and of the bearing strip.

11. A relay as claimed in claim 7, wherein the bearing strip is secured by a weld which fuses the side edges, resting against one another, of the bearing support, of the bearing strip and of the clamping plate.

12. A relay as claimed in claim 2, wherein the bearing strip is arranged with the flexible section between the armature and the bearing support and is secured, by an end section reaching around the bearing support on a side of the bearing support which faces away from the flexible section.

13. A method for producing a relay comprising the steps of:

a) arranging an armature connected to a contact arrangement is arranged on a base in such a way that bearing strips rest, with a capability of being displaced vertically, against bearing supports;

b) setting a predetermined contact separation by vertically displacing the armature;

c) connecting the bearing strips to the bearing supports in the set position of the armature;

d) pushing the coil equipped with the core, the pole shoes and the permanent magnet on to the base from above until predetermined operating air gaps of the armature are achieved.

14. A process as claimed in claim 13, wherein the armature with the contact arrangement is initially placed on to the base in such a way that all of the contacts are closed by an excess stroke, in that the armature is then raised by a predetermined amount and the bearing strips are finally welded to the bearing supports.

15. A method as claimed in claim 13, wherein after the contact separation has been set, the bearing strips are initially pre-fixed by a weld on the bearing support, in that an end section of the bearing support is then bent, to form a clamping plate, in the shape of a U over an end edge of the bearing strip, and in that the sections, resting against one another, of the bearing support, of the bearing strip and of the clamping plate are finally welded together.

16. A method as claimed in claim 13, wherein after the contact separation has been set, the free end sections of the bearing supports are bent, to form a clamping plate, in the shape of a U over the end section of the bearing support, embossed or bent projections of the bearing strips attaining a permanent connection for pre-fixing to the bearing supports, and in that afterwards the bearing strips are welded to the bearing supports.

17. A method as claimed in one of claims 13, wherein the bearing supports with extensions bent over in the shape of a V are initially bent outward at an acute angle until the armature having the bearing strips can be inserted between said supports, and in that the bearing supports are then bent into the vertical with respect to the bottom plane, in such a way that the extensions embrace the bearing strips.

18. A method as claimed in one of claims 13, wherein one or more welds, in particular laser welds, are produced in the edge region of the bearing strips and of the bearing supports for the purpose of securing the bearing strips.

19. A method as claimed in one of claims 13, wherein in each case the end sections of the bearing strips are connected by TIG welding to the associated bearing support and, if appropriate, the clamping plate for the purpose of securing said bearing strips.

* * * * *